United States Patent [19]

Johnson et al.

[11] Patent Number: 4,853,183

[45] Date of Patent: Aug. 1, 1989

[54] AIR MELTABLE CASTABLE CORROSION RESISTANT ALLOY AND ITS PROCESS THEREOF

[75] Inventors: Thomas E. Johnson, Helenville; John K. McBroom, Jr., Hartland, both of Wis.

[73] Assignee: Chas s. Lewis & Co., Inc., St. Louis, Mo.

[21] Appl. No.: 90,657

[22] Filed: Aug. 28, 1987

[51] Int. Cl.[4] ..... C22C 30/00

[52] U.S. Cl. ..... 420/454; 420/586; 148/3; 148/410

[58] Field of Search ..... 148/410, 3; 420/454, 420/585, 586.1

[56] References Cited

U.S. PATENT DOCUMENTS

| | | | |
|---|---|---|---|
| 2,185,987 | 1/1940 | Parsons et al. | 75/125 |
| 2,938,786 | 5/1960 | Johnson | 75/171 |
| 3,565,611 | 2/1971 | Economy | 75/171 |
| 3,758,296 | 9/1973 | Johnson | 75/122 |
| 3,813,239 | 5/1974 | Flint et al. | 75/122 |
| 3,817,747 | 6/1974 | Schultz et al. | 75/171 |
| 3,844,774 | 10/1974 | Culling | 75/134 F |
| 3,892,541 | 7/1975 | Forbes Jones | 29/196.1 |
| 3,893,851 | 7/1975 | Culling | 75/171 |
| 3,947,266 | 3/1976 | Culling | 75/170 |
| 4,033,767 | 7/1977 | Johnson | 75/170 |
| 4,155,751 | 5/1979 | Herchenroeder | 420/454 |
| 4,410,489 | 10/1983 | Asphani et al. | 420/453 |

FOREIGN PATENT DOCUMENTS

| | | | |
|---|---|---|---|
| 38633 | 7/1973 | Australia . | |
| 30784 | 1/1974 | Australia | 15.8/71.8 |
| 71689 | 11/1977 | Australia . | |
| 667661 | 7/1963 | Canada | 75/134 |
| 882039 | 9/1971 | Canada | 75/16 |
| 2169370 | 7/1973 | France . | |

*Primary Examiner*—Deborah Yee

*Attorney, Agent, or Firm*—Cohn, Powell & Hind

[57] ABSTRACT

A highly corrosion resistant, durable, strong, hardenable and relatively inexpensive nickel based alloy containing chromium and a high iron content has improved castability and weldability. The alloy contains approximately the quantities indicated: nickel 33 to 53 (to balance to 100 percent), chromium 20 to 25 percent, molybdenum 6 to 9 percent, cobalt 4 to 8 percent, iron 15 to 20 percent, manganese 2 to 4 percent, copper less then about 0.15 percent, carbon up to 0.2 percent and silicon 0.5 to 1.0 percent. The alloy is air meltable and produces a highly fluid castable melt. All percentages are by weight.

17 Claims, No Drawings

AIR MELTABLE CASTABLE CORROSION RESISTANT ALLOY AND ITS PROCESS THEREOF

BACKGROUND OF THE INVENTION

Applicant is aware of the following U.S. Patents.

| | |
|---|---|
| 2,185,987 | 2,938,786 |
| 3,758,294 | 3,758,296 |
| 3,813,239 | 3,817,747 |
| 3,844,774 | 3,892,541 |
| 3,893,851 | 4,033,767 |

The disclosures of the above listed patents are incorporated by reference herein.

Equipment used in highly corrosive environments typically is constructed of metal alloys such as stainless steel or other high alloys. These alloys are necessary to withstand the extremely corrosive effects of environments in which the equipment encounters chemicals such as concentrated sulfuric acid or concentrated phosphoric acid. A particularly difficult environment is encountered in making phosphate fertilizer. In the digestion of phosphate rock with hot, concentrated sulfuric acid, equipment must resist the environment at temperatures up to about 100° C. The impure phosphoric acid which is produced can be extremely corrosive and contains some residual sulfuric acid. The corrosive effect is often increased by other impurities in the phosphoric acid, particularly by halogen ions such as chloride and fluoride, which are normally present in the phosphate rock feedstock used in the process. An extremely corrosive environment is encountered in the concentration of the crude phosphoric acid.

Applicants have produced a new alloy which has particular corrosion resistance in the environment encountered in producing phosphate fertilizer. In addition to superior corrosion resistance, the new alloy is relatively inexpensive and is highly castable to form complex parts and shapes. The alloy may be prepared by conventional and inexpensive air melt techniques, which is a particular advantage. Applicants' alloy typically contains between about 20–25% chromium, 6–9% molybdenum, 0.5–1% silicon, 2–4% manganese, 15–20% iron, 4–8% cobalt, up to 0.2% nitrogen, up to 0.2% carbon and less than about 0.15% copper; a low copper content is preferred. The balance (about 33–53%) is nickel.

Applicants' alloy is an air melted, substantially copper free, nickel base corrosion resistant alloy. Applicant has discovered, contrary to conventional wisdom, that an essentially copper free alloy exhibits corrosion resistance equal to and in most instances significantly better than similar alloys containing copper, particularly in the severe environment encountered in the concentration of phosphoric acid for fertilizers. This is particular true where quantities of halogen ions, as chloride and fluoride, are present.

Applicants have discovered that their particular substantially copper free alloys are significantly superior to commerical alloys normally used in this service, such as Hasteloy C276. Applicants' alloys have the significant advantage that they may be formed by standard air melting techniques and do not required the special techniques required by conventional high alloys used in this service, such as vacuum or electroslag processing. High alloys requiring such low carbon and silicon residuals must be melted using specialized melting techniques and are generally available only in wrought form. They cannot be produced by casting in commercial foundries using air melting techniques.

The very low carbon and silicon contents which are specified for the commercial high alloys are produced by these expensive melting techniques. It is known that a relatively high silicon content promotes fluidity of the molten metal and renders the melt castable. At the extremely low silicon content specified for the high alloys, the molten metal lacks fluidity and cannot be cast by conventional sand, investment or centrifugal foundry methods.

It is generally known that copper content in corrosion resistant alloys, such as the austentic stainless steels and certain other high nickel alloys, enhances the corrosion resistance of these alloys in environments where the alloys are exposed to acids of sulfur and phosphorus. Typical corrosion resistant alloys make use of a significant copper content to achieve better corrosion resistance. It is known that if the copper content is too high, it can cause a condition known as hot shortness in the alloys which makes them difficult to cast or hot work. Copper also may reduce the weldability of these alloys, but conventionally, significant copper content is desirable. Applicant's have found, however, that they can product a highly corrosion resistant alloy which is essentially copper free. In doing so, applicants also have produced an alloy which is weldable, which can result in high process yields and in a reduction of scrap and waste metal. These factors all contribute to a much lower product cost in applicants' alloy.

Phosphate rock deposits at various locations in the world vary greatly in chemical composition. The most severe corrosion environments are typically encountered in processing deposits of phosphate rock which contain a high content of halogens, such as chloride or fluoride. It is an object of applicants' invention to produce a material of construction suitable for use in processing such phosphate rock which presents a severely corrosive environment.

It is also an object of applicants' invention to produce a corrosion resistant alloy which is low in copper and which has an enchanced corrosion resistance.

It is a further object of applicants' invention to produce a highly corrosion resistant alloy which contains silicon in sufficient quantity to render the alloy castable by conventional methods.

It is an object of applicants' invention to produce a highly corrosion resistant alloy which contains silicon.

It is an object of applicants' invention to produce a corrosion resistant alloy that is essentially copper free.

It is an object of applicants' invention to produce a corrosion resistant alloy which has high strength and hardness properties.

Applicants' substantially copper free alloy may be made in two forms, depending upon the level of carbon in each form. The ultra low carbon alloys of applicants' invention have a carbon content of less than about 0.08% and have an austenitic solid solution structure when solution treated. The low carbon alloys, with a carbon content of between about 0.10 and 0.20%, exhibit a precipitation of a Chinese script configuration. It will be understood that, as used herein, the terms "low carbon" and "ultra low carbon" are meant to describe alloys having the above carbon contents. The precipitates have been identified as heavy metal carbides. The micro hardness test, converted to Rockwell C scale, shows a matrix hardness in the low carbon alloy matrix of about 26.7 and about 52.3 hardness in the carbide. The low carbon alloys do not have the exceptionally high corrosion resistance exhibited by the ultra low carbon alloy. However, the low carbon alloys have a structure which may be highly useful in corrosive services where physical abrasion, erosion or galling is encountered.

The invention may be further understood by reference to the following Description of the Preferred Embodiments.

DESCRIPTION OF THE PREFERRED EMBODIMENTS

The alloys of the invention are nickel base alloys with high iron and moderate to high chromium content. The alloys contain between about 33 to 53 percent nickel, preferrably about 42 percent (to balance to 100 percent), about 20 to 25 percent chromium, about 6 to 9 percent molybdnum, about 4 to 8 percent cobalt, about 15 to 20 percent iron, about 2 to 4 percent manganese and about 0.5 to 1.0 percent silicon. The alloy is substantially copper free, having less than about 0.15 percent copper and preferably having substantially less than 0.15%. The alloy may contain up to about 0.2 percent carbon, preferrably up to about 0.08% carbon and having an austenitic composition or containing about 0.10 and 0.20 percent carbon and having an extremely hard Chinese script precipitated structure in an austenitic matrix. The alloy may also contain minor amounts of tramp or extraneous elements, as is typical in alloy compositions, for example, sulfur and phosphorous. It is prefered that these elements be kept to as low a level as conveniently possible. Preferrably sulfur is maintained below about 0.025 percent by weight and phosphorous below about 0.025 percent by weight. Nitrogen, up to about 0.20% by weight, may be used as an alloy ingredient to promote formation of an austenitic structure and to increase strength.

Nickel is present in the alloy as the base metal and at a relatively high percent. Nickel adds greatly to the corrosion resistance of the alloy. The chromium level is at a moderate/high level of between about 20 and 25 percent by weight. It is preferred that the chromium present be added, within these limits, at a high level to add corrosion resistance and strength to the alloy. The addition of cobalt and manganese to the alloy also adds additional strength and contributes to the corrosion resistance.

Applicants have found that the elimination of copper from the alloy, to the greatest extent possible, greatly improves the castability of the alloy and unexpectedly provides an alloy having as high or higher corrosion resistance than conventional alloys containing copper. In addition, the weldability of the alloy is greatly improved by the omission of copper from the alloy. It is preferred that the copper content be kept as low as possible and preferably substantially below 0.15 percent by weight.

The silicon content in this alloy should be as low as possible to provide increased corrosion resistance in the severe halogen containing phosphoric acid environments. However, reducing silicon in alloys is known to reduce the fluidity of the melt and inhibit the castability of the alloys, particular using conventional air melt, gravity casting techniques. Applicants have found however, that they can reduce the silicon content substantially below 1.0 percent by weight, in this alloy, and still provide an alloy which is highly fluid in the molten state. Applicants' alloys produce superior cast articles, even when casting complex shapes. In addition, applicants have found that, at this low silicon content, the corrosion resistance of their alloy against halide containing phosphoric acid is greatly improved. Preferably the silicon content is between about 0.5 and 1.0 percent by weight.

It is desirable that, within the limits set, iron also be included at as high a level as conveniently possible. Having a high iron content reduces the cost of the alloy, since iron is a much less expensive constituent then nickel, chromium and the other high alloy metals. Moreover, having the high iron content permits the inclusion of alloy constituents in their alloyed form with iron, rather than requiring the use of pure alloying metals. This reduces the cost of preparation of the alloy. Moreover, applicants have found that within the limits of their alloy, the presence of iron does not detract from the overall corrosion resistance, weldability, and castability of their alloy product. While applicants' alloy is described as a castable alloy, it will be understood that it may be readily machined by conventional processes, such as turning, milling or drilling, as required to produce a finished product.

Applicants' alloy may take two finished forms. In the first form, applicants' alloy has a carbon composition of up to about 0.08 percent, preferably between about 0.02–0.08%. This form, designated the ultra low carbon form, exhibits an austenitic structure and has very high corrosion resistance in the target environment, particularly where the environment contains halide ion, such as chloride and fluoride. The second type of applicants' alloy is designated the low carbon form. This form typically has the carbon content between about 0.1 and 0.2 percent by weight. The low carbon form has a two phase structure having an austenitic matrix containing Chinese script carbon precipitates. The precipitates have exceptional hardness. While the low carbon alloys do not have the very high corrosion resistance in the target environment exhibited by the ultra low carbon alloys, they may be used for service exhibiting corrosion, abrasion, erosion and galling. The low carbon alloys can find exceptional utility in an environment having both high corrosion and abrasive factors, such as pumping of slurries of acidified phosphate rock, as might be encountered in phosphoric acid production.

The preferred composition of applicants' ultra low carbon alloy is nickel about 41.7%, chromium about 22.5%, molybdenum about 8.0%, cobalt about 6–8%, iron about 16%, manganese about 2.5–3.0%, carbon up to about 0.08%, silicon about 0.6–0.75% and copper below about 0.15%.

The following tables show examples of alloys made within the concepts of the invention compared with conventional alloys. LEWMET 25 (TM) is a commercial version of alloys disclosed in U.S. Pat. No. 3,758,296. All of the examples, as summarized in Tables I through IV, are alloys made by conventional air melt techniques with the exception of the commercial alloys Hasteloy (TM) C276 and Carpenter (TM) 20Cb3. Hasteloy (TM) C276 is an example of a super low carbon and silicon wrought alloy requiring a specialized melting process. Carpenter 20Cb3 is a commercial wrought material. Also compared in the Tables are two versions of conventional type 316 stainless steel (CF8M and CFBMX). Table I shows a comparison of the compositions of these alloys. The experimental material shown in the tables was made in a conventional electric furnace by melting the ingredients together in the proper proportions, deoxidizing and casting test bars using conventional gravity casting techniques. The cast bars were heat treated and subjected to the tests shown in Tables I through IV. A solution heat treatment, such as a solution heat treating in excess of 2000° F.(1050° C.) and water quench, is satisfactory.

TABLE I A

| | Summary - Experimental Heats Analysis - Weight Percent | | | | | | |
|---|---|---|---|---|---|---|---|
| | Ultra Low Carbon Heats | | | | | Low Carbon Heats | |
| Element | J526 | N318 | N340 | N853 | P3483 | N339 | N1148 |
| Carbon | 0.02 | 0.04 | 0.05 | 0.02 | 0.02 | 0.10 | 0.18 |
| Chromium | 22.62 | 22.74 | 24.69 | 22.40 | 22.45 | 20.02 | 20.15 |
| Nickel (by difference) | 43.56 | 43.45 | 43.12 | 43.69 | 43.56 | 43.06 | 42.43 |
| Molybdenum | 7.75 | 8.25 | 6.31 | 8.05 | 8.78 | 9.06 | 8.69 |
| Silicon | 0.58 | 0.59 | 0.93 | 0.67 | 0.88 | 0.75 | 0.52 |
| Manganese | 2.41 | 2.42 | 1.93 | 2.85 | 2.86 | 3.12 | 3.75 |
| Copper | 0.08 | 0.11 | 0.08 | 0.10 | 0.06 | 0.09 | 0.09 |
| Iron | 16.62 | 16.55 | 18.81 | 16.17 | 15.25 | 15.67 | 15.98 |
| Cobalt | 6.34 | 5.83 | 3.98 | 5.95 | 5.92 | 8.06 | 8.20 |
| Nitrogen | — | 0.06 | 0.07 | 0.08 | 0.22 | 0.05 | — |
| Sulfur | .010 | .012 | .008 | .012 | .009 | .007 | .006 |
| Phosphorus | .012 | .013 | .024 | .012 | .005 | .017 | .006 |

TABLE I B

| | Analysis of Other Alloy Tested - Weight Percent | | | | |
|---|---|---|---|---|---|
| Element | Hastelloy C276 | Alloy 20Cb3 | CF8M | CF8MX | Lewmet 25 (J525) |
| Carbon | .002 | 0.03 | 0.06 | 0.02 | 0.03 |
| Chromium | 15.63 | 19.31 | 18.72 | 17.39 | 22.45 |
| Nickel | 54.28 | 33.09 | 9.26 | 11.94 | 41.76* |
| Molybdenum | 15.47 | 2.18 | 2.29 | 1.96 | 7.36 |
| Silicon | .002 | 0.40 | 1.57 | 0.50 | 0.81 |
| Manganese | 0.42 | 0.25 | 0.70 | 1.30 | 2.63 |
| Copper | 0.10 | 3.23 | 0.55 | 0.33 | 2.93 |
| Iron | 5.91 | Bal | Bal | Bal | 17.67 |
| Cobalt | 2.13 | — | — | — | 6.14 |
| Tungsten | 3.63 | — | — | 0.43 | — |
| Sulfur | .002 | .001 | NA | .012 | .007 |
| Vanadium | 0.13 | — | — | — | — |
| Aluminum | 0.23 | — | — | — | — |
| Cb & Ta | — | 0.66 | — | — | — |
| Phosphorus | .006 | .023 | NA | .030 | .010 |

*By Analysis

Table II summarizes the comparison of corrosion testing of these alloys in the environment noted in Table II. The alloys were prepared as conventional test blanks and subjected to a series of corrosion tests. A series was tested in phosphoric acid at 90° C. The test were run for 96 hours. Where noted, the test samples were subjected to temperatures of 115° C. for twelve hours. This extremely severe test occurred as a result of the malfunction of the test equipment. The composition of phosphoric acid was ajusted to have the chloride ion content as noted. The phosphoric acid was a crude phosphoric acid typical of acids used in producing phosphate fertilizer using Florida phosphate rock. Two standard grades, 32% $P_2O_5$ and 54% $P_2O_5$, were tested. A third grade tested, 42% $P_2O_5$, was manufactured by a different commercial process also using Florida rock. These acids contained approximately 2.2 percent fluoride ion, in the 54 percent $P_2O_5$ acid, and 1.25 percent fluoride ion the 32 percent $P_2O_5$ . These acid compositions are typical of those which would be encountered in severe phosphoric acid environments with high halide ion content.

As can be seen from Table II, applicants' new ultra low carbon alloys in particular tested as being superior to conventional wrought and cast materials. The resistance of applicants' new alloys to 32% $P_2O_5$ solutions containing halide ion tested as being highly superior to the best conventional material tested, LEWMET 25. The 32% $P_2O_5$ solutions are typical of environments encountered in phosphoric acid concentration.

TABLE II A

| | Static Corrosion Laboratory Tests in $H_3PO_4$ Rates - mils per year (0.001 inch per year) (Test run for 96 hours in non-aerated acid at 90° C., except where noted) | | | | | | |
|---|---|---|---|---|---|---|---|
| Acid | Ultra Low Carbon | | | | | Low Carbon | |
| Environment | J526 | N318 | N340 | N853 | P3483 | N339 | N1148 |
| 32% $P_2O_5$ | 0.5 | 1.0 | 0.4 | 0.6 | 1.4 | 6.2 | 9.7 |
| 32% $P_2O_5$ 500 ppm Cl— | 1.3 | 0.7 | 0.7 | 1.0 | 0.7 | 6.3 | 12.6 |
| 32% $P_2O_5$ 1000 ppm Cl— | 0.9 | 0.9 | 0.7 | 0.7 | 1.0 | 5.3 | 8.2 |
| 32% $P_2O_5$ 5000 ppm Cl— | 0.8 | 0.6 | 0.7 | 1.3 | 1.0 | 18.4 | 52.7 |
| 32% $P_2O_5$ 10,000 ppm Cl— | 1.0 | 1.1 | 5.5 | 1.1 | | | |
| 32% $P_2O_5$ 15,000 ppm Cl— | 0.7 | | 0.6 | | | | |
| 54% $P_2O_5$ | 1.1 | 1.5 | 0.9 | 1.4 | 1.9 | 2.9 | 4.5 |
| 54% $P_2O_5$ 500 ppm Cl— | 2.7 | 1.9 | 1.5 | 1.7 | 1.3 | 3.7 | 2.4 |
| 54% $P_2O_5$ 1000 ppm Cl— | 1.7 | 1.5 | 1.3 | 2.0 | 1.9 | 4.2* | 11.3* |
| 54% $P_2O_5$ 5000 ppm Cl— | 3.6* | 3.8* | 4.2* | 2.9* | 4.1* | 27.3 | 154.0 |
| 42% $P_2O_5$ 20,000 ppm Cl— | 0.9 | | | | | | |
| 42% $P_2O_5$ 30,000 ppm Cl— | 1.1 | | | | | | |

*Temperature to 115 degrees C. for 12 hours

TABLE II B

| | Static Corrosion Laboratory Tests in $H_3PO_4$ Rates - mils per year (0.001 inch per year) (Test run for 96 hours in non-aerated acid at 90° C., except where noted) | | | | |
|---|---|---|---|---|---|
| Acid Environment | C-276 | CF8MX | CF8M | 20Cb3 | Lewmet 25 (J525) |
| 32% $P_2O_5$ | 5.0 | 7.8 | 3.3 | 1.3 | 0.4 |
| 32% $P_2O_5$ 500 ppm Cl— | 4.6 | 10.0 | 3.9 | 2.8 | 1.4 |
| 32% $P_2O_5$ 1000 ppm Cl— | 4.2 | 19.7 | 6.9 | 4.2 | 1.6 |
| 32% $P_2O_5$ 5000 ppm Cl— | 5.1 | 534 | 252 | 459 | 1.1 |
| 32% $P_2O_5$ 10,000 ppm Cl— | 8.7 | | | | 8.1 |
| 32% $P_2O_5$ 15,000 ppm Cl— | 6.0 | | | | |
| 54% $P_2O_5$ | 1.5 | 7.9 | 7.1 | 4.1 | 1.8 |
| 54% $P_2O_5$ 500 ppm Cl— | 1.6 | 103 | 5.6 | 53.6 | 2.4 |

TABLE II B-continued

Static Corrosion Laboratory Tests in $H_3PO_4$ Rates - mils per year (0.001 inch per year) (Test run for 96 hours in non-aerated acid at 90° C., except where noted)

| Acid Environment | C-276 | CF8MX | CF8M | 20Cb3 | Lewmet 25 (J525) |
|---|---|---|---|---|---|
| 54% $P_2O_5$ 1000 ppm Cl— | 2.0 | | 148 | 94 | 2.0 |
| 54% $P_2O_5$ 5000 ppm Cl— | 2.8 | | | | 3.6 |
| 42% $P_2O_5$ 20,000 ppm Cl— | 6.8 | | | | 1.1 |
| 42% $P_2O_5$ 30,000 ppm Cl— | 5.0 | | | | 1.1 |

In Table III a number of applicants' alloys were subjected to comparative tests in aerated 98 percent sulfuric acid. The tests were conducted at 100° C., 110° C. and 120° C. As can be seen, the alloy exhibits a high degree of corrosion resistance in concentrated sulfuric acid, particularly at temperatures of 100° C. and below, as would normally be encountered in handling sulfuric acid in a phosphoric acid plant.

TABLE III

Average corrosion rates - Ultra Low C - Low Cu experimental heats in 98% Sulfuric acid - Rates inches per year

| | 100° C. | | 110° C. | | 120° C. | |
|---|---|---|---|---|---|---|
| Heat No. | Tests | ipy | Tests | ipy | Tests | ipy |
| J526 | 6 | .010 | 2 | .041 | 1 | .044 |
| N318 | 1 | .021 | 1 | .019 | 1 | .060 |
| N340 | 1 | .017 | 1 | .014 | 1 | .043 |
| N853 | 1 | .010 | 2 | .048 | 2 | .029 |
| P3483 | 2 | .022 | 2 | .015 | 3 | .051 |
| | 11 | .014* | 8 | .030* | 8 | .045* |

*Weighted Average Rates

Table IV shows the hardness and strength data for applicants' alloys. It can be seen that applicants' alloys have a high degree of mechanical strength and hardness, which makes them particularly suited for structural and mechanical components in contact with corrosive environments.

TABLE IV A

Mechanical Test Data (solution heat treated at 2150° F. - 2235° F. for one hour per inch of metal section and water quenched)

| HEAT NO. | Yield -psi | Tensile -psi | Elong. % | R.A. % | Brinell | Type |
|---|---|---|---|---|---|---|
| J526 | 37,090 | 69,670 | 56.0 | 58.4 | 163 | Cast |
| N318 | 42,190 | 83,370 | 61.5 | 60.8 | 170 | Cast |
| N340 | 45.290 | 90,600 | 64.0 | 59.5 | 166 | Cast |
| P3483 | 49.320 | 92,100 | 66.5 | 66.8 | 207 | Cast |
| N853 | 40,760 | 80,020 | 59.5 | 56.4 | 153 | Cast |
| P339 | 45,360 | 77,940 | 21.0 | 22.5 | 197 | Cast |
| N1148 | 48,180 | 75,140 | 11.0 | 10.4 | 207 | Cast |

TABLE IV B

Mechanical Properties of Other Alloys Tested

| Alloy | Yield -psi | Tensile -psi | Elong. % | R.A. % | Brinell | Type |
|---|---|---|---|---|---|---|
| Hastelloy (TM) C276 | 53,000 | 113,000 | 65 | 76 | 170 | Wrought |
| Carpenter (TM) 20Cb3 | 58,000 | 98,500 | 38 | 67 | 197 | Wrought |
| CF8MX | 30,800 | 65,700 | 50.5 | 67 | 137 | Cast |

TABLE IV B-continued

Mechanical Properties of Other Alloys Tested

| Alloy | Yield -psi | Tensile -psi | Elong. % | R.A. % | Brinell | Type |
|---|---|---|---|---|---|---|
| CF8M* | 42,000 | 80,000 | 50.0 | NA | 170 | Cast |
| Lewmet 25 (TM) | 37,850 | 71,430 | 63.5 | 62.9 | 163 | Cast |

*Typical Value

A leg of standard cast keel bar as described in ASTM Standard A370 was sectioned from a bar cast from experimental heat No. N318. A section was removed from the cut surface of the bar and weld filler metal applied. The bar was then solution heat treated and submitted to an independent commercial laboratory for evaluation. No fracture was observed in bending the bar 180 degrees on a 1½ inch radius. This test indicated excellent weldability.

Evaluation of the castability of the experimental alloys was made by making experimental castings of the general type used in this service. These included pump propellers and pump casings. The molten metal exhibited adequate fluidity filling all voids in the molds. No hot shortness or cracking was evident even when castings were water quenched from high temperature in the heat treating process.

Various changes and modifications may be made within the purview of this invention, as will be readily apparent to those skilled in the art. Such changes and modifications are within the scope and teachings of this invention as defined by the claims appended hereto. The invention is not to be limited by the examples given herein for purposes of illustration, but only by the scope of the appended claims and their equivalents.

We claim:

1. An air meltable, nickel-based alloy having high corrosion resistance to severe phosphoric acid environments, said alloy having a copper content of less then about 0.15 percent by weight and a silicon content of between about 0.5 and 1.0 percent by weight, between about 12–20% iron, between about 20–25% chromium, between about 33–53% nickel, between about 6–9% molybdenum, between about 4–8% cobalt, and between about 2–4% manganese, said alloy having a highly fluid and castable melt to form complex shapes, and having a high resistance to concentrated phosphoric acid, the combination of low copper content and the presence of silicon produces a highly castable alloy that retains a high corrosion resistance in severe phosphoric acid environments.

2. The alloy of claim 1 wherein the alloy has an austenitic matrix.

3. The alloy of claim 1 wherein the alloy contains up to about 0.08 percent by weight carbon.

4. The alloy of claim 1 wherein the alloy is highly corrosion resistant in phosphoric acid environments containing halogen ions.

5. An air meltable, nickel-based alloy having high corrosion resistance to severe phosphoric acid environments, the alloy having the following approximate composition by weight:

| | |
|---|---|
| nickel | 33–53% (to balance) |
| chromium | 20–25 |
| molybdenum | 6–9 |
| cobalt | 4–8 |
| iron | 15–20 |

-continued

| | |
|---|---|
| manganese | 2–4 |
| silicon | 0.5–1.0 |
| copper | 0–0.15 |
| carbon | up to 0.2 |
| nitrogen | up to 0.2 |

wherein the melt of the alloy is highly fluid and castable.

6. The alloy of claim 5 wherein the alloy contains up to about 0.08% carbon.

7. The alloy of claim 5 wherein the alloy contains between about 0.1 to 0.2% carbon.

8. The alloy of claim 7 wherein the alloy has an austenitic base matrix containing a hard carbide precipitate phase.

9. The alloy of claim 8 wherein the precipitate phase has a Chineses script configuration.

10. An air meltable, nickel-based alloy having a high corrosion resistance to severe phosphoric acid environments, comprising between about 12–20% iron, between about 20–25% chromium, between about 33–53% nickel, between about 6–9% molybdenum, between about 4–8% cobalt, between about 2–4% manganese and between about 0.5–1.0% silicon, the silicon being effective to produce a highly fluid castable melt, and the alloy being essentially copper free, the combination of substantially copper free composition and the presence of silicon produces a weldable alloy castable to form complex shapes and having high corrosion resistance to severe phosphoric acid environments containing chlorine and fluorine.

11. The alloy of claim 10 wherein the alloy contains up to about 0.08% carbon.

12. The alloy of claim 11 wherein the alloy is austenitic.

13. The alloy of claim 10 wherein the alloy contains up to about 0.2% nitrogen.

14. A method of producing an alloy having a high corrosion resistance to severe phosphoric acid environments, consistng essentially of air melting a nickel-based alloy containing a high iron content and moderate to high chormium content, adding an amount of silicon effective to produce a highly fluid castable melt, and maintaining the copper content at less than about 0.15% by weight, the alloy containing between about 12–20% iron, between about 20–25% chromium, between about 33–53% nickel, between about 6–9% molybdenum, between about 4–8% cobalt, between about 2–4% manganese and between about 0.5–1.0% silicon, casting the alloy to form structural elements and heat treating the formed structural elements the combination of low copper content and the presence of silicon produces a weldable alloy which is highly castable to form complex shapes and which retains a high corrosion resistance in phosphoric acid environments.

15. The method of claim 14 wherein the structural elements are solution heat treated.

16. The method of claim 14 wherein the alloy is essentially copper free and the carbon content is less than about 0.08%.

17. A method of producing an alloy having a high resistance to severe phosphoric acid environments comprising air melting a nickel-based alloy containing a high iron content and a moderate to high chromium content, adding an amount of silicon effective to produce a highly fluid castable melt, and maintaining the copper content at less than about 0.15% by weight, casting the alloy to form structural elements and heat treating the formed structural elements, the alloy having the following approximate composition by weight:

| | |
|---|---|
| nickel | 33–53% (to balance) |
| chromium | 20–25 |
| molybdenum | 6–9 |
| cobalt | 4–8 |
| iron | 15–20 |
| manganese | 2–4 |
| silicon | 0.5–1.0 |
| copper | ≦0.15 |
| carbon | up to 0.2 |
| nitrogen | up to 0.2 |

* * * * *